US008393132B2

(12) United States Patent
Waeckerlin

(10) Patent No.: US 8,393,132 B2
(45) Date of Patent: Mar. 12, 2013

(54) DEVICE AND METHOD FOR FILLING CONTAINERS

(75) Inventor: Juerg Waeckerlin, Beringen (CH)

(73) Assignee: Robert Bosch GmbH, Stuttgart (DE)

( * ) Notice: Subject to any disclaimer, the term of this patent is extended or adjusted under 35 U.S.C. 154(b) by 824 days.

(21) Appl. No.: 11/914,672

(22) PCT Filed: Apr. 21, 2006

(86) PCT No.: PCT/EP2006/061737

§ 371 (c)(1),
(2), (4) Date: Nov. 16, 2007

(87) PCT Pub. No.: WO2006/125703

PCT Pub. Date: Nov. 30, 2006

(65) Prior Publication Data

US 2008/0190075 A1 Aug. 14, 2008

(30) Foreign Application Priority Data

May 24, 2005 (DE) ..... 10 2005 023 810

(51) Int. Cl.
*B65B 3/02* (2006.01)
*B65B 5/00* (2006.01)

(52) U.S. Cl. ..... 53/458; 53/249; 53/250; 53/251; 53/452; 53/457

(58) Field of Classification Search ..... 198/457.01, 198/457.03, 457.06, 461.1, 418.1, 604, 426, 198/427, 429, 430, 436, 445, 575, 582; 53/249–251, 53/458, 452, 457
See application file for complete search history.

(56) References Cited

U.S. PATENT DOCUMENTS

| | | | | | |
|---|---|---|---|---|---|
| 2,953,234 | A | * | 9/1960 | Abendschein | 198/447 |
| 3,269,091 | A | | 8/1966 | Martin | |
| 3,301,380 | A | * | 1/1967 | Schickle | 198/401 |
| 3,373,664 | A | | 3/1968 | Brockmuller | |
| 3,416,641 | A | * | 12/1968 | Hollenton | 198/418.1 |
| 3,576,246 | A | * | 4/1971 | Hulet et al. | 198/457.01 |
| 3,604,551 | A | * | 9/1971 | Fink | 198/448 |

(Continued)

FOREIGN PATENT DOCUMENTS

| | | |
|---|---|---|
| DE | 86 22 831 U | 1/1988 |
| DE | 38 08 761 A1 | 9/1989 |

(Continued)

*Primary Examiner* — Hemant M Desai
*Assistant Examiner* — Gloria R Weeks
(74) *Attorney, Agent, or Firm* — Michael Best & Friedrich LLP

(57) ABSTRACT

A packaging station of a packaging machine for filling containers with products, the station comprising a transport device for feeding the products along a feed path and via first and second charging paths which run parallel to said feed path and transport the containers. The containers are filled by a filling device designed to seize one or more of the products from the feed path and to place said seized products into one or more containers on one or other of the charging paths. The charging paths consist of the following sequence of items, listed in order in the displacement direction of the containers to be filled: a set-up assembly, a transport device and a sealing unit. The device and method permit a more rapid filling of packaging materials with products in a relatively small space, in particular on a platform.

10 Claims, 1 Drawing Sheet

U.S. PATENT DOCUMENTS 3,642,158 A * 2/1972 Koennecke et al. ..... 414/421
3,645,068 A * 2/1972 Langen ..... 53/566
3,759,368 A * 9/1973 Rose et al. ..... 198/437
3,777,873 A * 12/1973 Stuart ..... 198/346.2
3,788,034 A * 1/1974 Hartness et al. ..... 53/248
3,854,270 A * 12/1974 Cloud et al. ..... 53/540
4,132,191 A * 1/1979 Frederick et al. ..... 118/409
4,394,902 A * 7/1983 Mazzoni ..... 198/436
4,401,020 A * 8/1983 Brux ..... 100/7
4,413,659 A * 11/1983 Zangerle ..... 140/3 CA
4,442,932 A * 4/1984 Sashiki et al. ..... 198/370.07
4,802,324 A * 2/1989 Everson ..... 53/398
5,060,455 A * 10/1991 Schmeisser ..... 53/448
5,360,306 A * 11/1994 Nakayama et al. ..... 414/331.08
5,456,563 A * 10/1995 Halbo ..... 414/416.06
5,636,726 A * 6/1997 Nield ..... 198/430
5,927,053 A 7/1999 Donovan et al.
6,006,493 A * 12/1999 Focke et al. ..... 53/247
6,026,947 A * 2/2000 Persson ..... 198/364
6,122,895 A 9/2000 Schubert
6,223,884 B1 * 5/2001 Ronchi ..... 198/457.01
6,296,103 B1 * 10/2001 Gross ..... 198/429
6,520,317 B2 2/2003 Sherwin
7,051,863 B2 * 5/2006 Fujimura et al. ..... 198/575
7,222,718 B2 * 5/2007 Tarlton ..... 198/445
7,222,721 B2 * 5/2007 Fujimura et al. ..... 198/575
2002/0157919 A1 10/2002 Sherwin
2002/0175045 A1 * 11/2002 Sjogren ..... 198/426
2003/0182898 A1 * 10/2003 Huppi et al. ..... 53/251

FOREIGN PATENT DOCUMENTS

DE 44 47 050 A1 7/1996

* cited by examiner

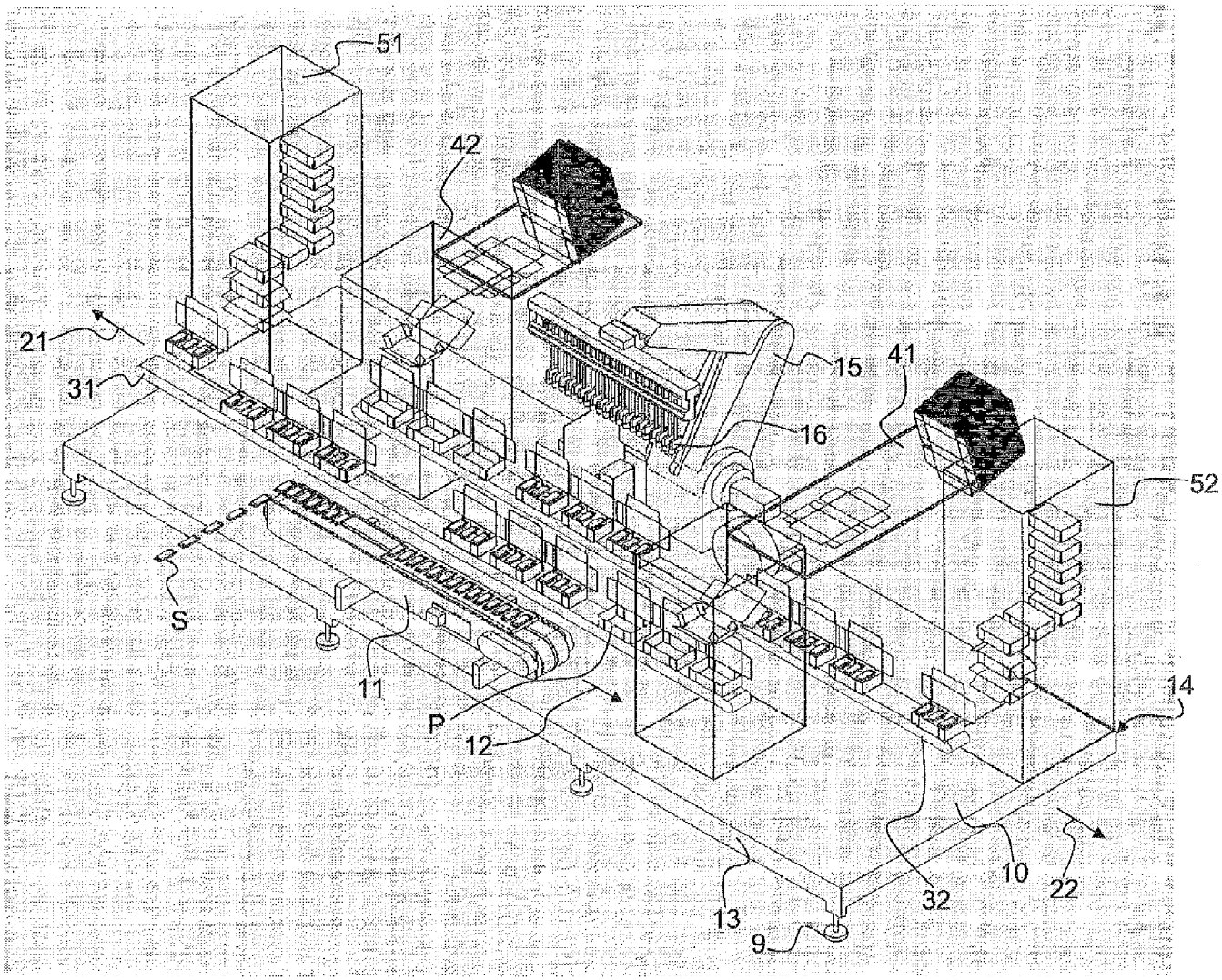
52
14
22
10
32
9
13
12
P
11
S
31
21
51
42
41
15
16

DEVICE AND METHOD FOR FILLING CONTAINERS

CROSS-REFERENCE TO RELATED APPLICATION

This application is a 35 USC 371 application of PCT/EP 2006/061737 filed on Apr. 21, 2006.

BACKGROUND OF THE INVENTION

1. Field of the Invention

The invention relates to a device for and a method of filling boxes or containers with products especially well suited for filling at high box output.

2. Description of the Prior Art

Devices for filling containers with products of the type with which this invention are known. Although they make it possible to fill the containers safely and in an expedited way, there is still a need on the part of users to increase the box output of such a system in a simple way.

From U.S. Pat. No. 6,520,317, one such system and method are known, in which the objects to be packaged are delivered on a single product conveyor belt. The empty packaging containers are delivered on a different container conveyor belt, which is split in two, one on either side of the product conveyor belt that transports the objects to be packaged; thus three parallel-extending belts move past a robot arm, which retrieves the arriving objects to be packaged from the product conveyor belt and transfers them to the containers on the two container conveyor belts moving past. The trailing container conveyor belts are then reunited into a single trailing container conveyor belt and the containers leave the station on it.

This devices has the disadvantage that while it has a simple interface configuration of the delivery and removal devices, namely one incoming product conveyor belt each, an arrangement that furnishes a container conveyor belt with erected boxes, and a device that guides the container conveyor belt out of the station, but is intrinsically relatively complex internally, so that only a comparatively slight increase in the box output can be achieved.

SUMMARY AND ADVANTAGES OF THE INVENTION

Based on this prior art, it is the object of the invention to attain greater output of filled boxes per minute over a small base area of a packaging station, with simpler equipment.

The feed device of the invention in a packaging machine has a conveyor for delivering the products along a feed path, a first loading path disposed parallel to the feed path, and a second loading path, disposed parallel to the first, that is advantageously operated in the opposite direction.

Preferably, an erecting device for the boxes to be filled is located upstream along the first and second loading paths, respectively; the aforementioned transporting device for the boxes to be filled follows, and downstream of it is a closure device for the filled boxes, all in a straight line one after the other.

Advantageously, the entire device is disposed on a single platform. In the preferred embodiment of such a device, the closure devices are provided in two of the corners of the platform that are diametrically opposite the delivery belt or conveyor device for the products. For optimal and easily overseen utilization of space on such a platform, the filling device, in particular a robot, is itself disposed approximately centrally on the platform.

In an advantageous embodiment of the packaging station, the functions of the erecting device, that is, separating the blanks, the folding operations, and erecting the boxes, are provided from above the platform downward onto the platform plane. On the other hand, the closure device is advantageously designed such that the closure of the lid of the boxes, stapling of the boxes, and their discharge in succession away from the platform level, is done from the bottom up.

With such a packaging station and the corresponding method, the following facts are advantageously directly utilized: For a typical size of box and number of products, known robot arms can attain a filling output of 90 to 150 boxes per minute; a product conveyor belt can readily attain cycle rates that allow filling 150 boxes per minute; and container conveyor belts with an upstream erecting device and a downstream closure device, although they have a throughput of only about 45 boxes per minute, for example, are nevertheless independently connected in parallel, making it possible to double the aforementioned throughput and thus bring it up to the level of the other system components.

Thanks to the device of the invention, it is thus possible, on a single platform of conventional size, to attain a box output of 90 boxes per unit, for example.

BRIEF DESCRIPTION OF THE DRAWING

One exemplary embodiment of the invention is described more fully herein below, with reference to the sole drawing FIGURE which shows a schematic, perspective view of a device according to the invention, with products to be packaged and with circulating boxes.

DESCRIPTION OF THE PREFERRED EMBODIMENT

In the packaging machine 1 shown here, the individual flat, block-shaped articles or products S are delivered to an empty package P, which is a block-shaped box with a lid and corresponding tabs. Naturally, the products S may be of some other shape, for instance in the form of cylinders, pills, or defined by polygonal lines, and so forth. What is essential is that they can be grasped individually by a filling device.

The products S are furnished from an interface, not shown, above a platform 10, horizontally transversely to one edge or long side 13 of the platform. The arriving products S are deflected at a right angle and delivered to an endlessly revolving conveyor belt 11 along a feed-conveyor course 12. This may be a conveyor chain or some other suitable conveyor means that drives the products forward in indexed fashion or continuously along the feed path 12. The revolving conveyor belt 11 is disposed in the vicinity of the front edge 13 of the platform 10. The platform stands on feet 9, four of which are shown in the region of the front edge 13. The feet 9 may in particular be adjustable in height, in order to align the platform 10 horizontally. A suitable platform 10 may for instance measure 8 meters by 2 meters and may comprise grid plates, for the sake of easy fixation of the elements shown in the drawing.

On the diametrically opposite long edge 14 of the platform 10, there is a filling device 15 in the form of a known two-axis or three-axis robot, which has a plurality of grippers 16 arranged parallel to the feed path 12. The motion of the grippers 16 of the arm of the robot 15 is possible at least in the direction transversely to the conveyor path 12 and vertically.

As noted, in other exemplary embodiments of the invention, still other filling devices 15 may be used, as long as they are devices that individually or in combination are capable of lifting the products S from a feed path 12 and setting them down on or in boxes P essentially from above. The loading is advantageously done strictly in alternation.

Parallel to the feed path 12, first and second loading paths 21 and 22 are shown, indicated only schematically. The paths 21 and 22 are provided with an arrow indicating the loading direction. The paths 21 and 22 extend parallel to the feed path 12 and move in opposite directions relative to one another.

For the sake of clarity, a detailed illustration of the product transporting devices 31 and 32, which accomplish the transporting of the boxes P along the paths 21 and 22, respectively, has been dispensed with. These devices 31 and 32 are shown merely by the indication of a conveyor belt. These devices 31 and 32 may be endless conveyors, conveyor chains, or other suitable conveyor devices 31 and 32. In principle, they may also be designed differently, although the use of two identical, contrarily operating devices on the respective loading paths 21 and 22 offers advantages in terms of maintenance.

It is essential that the loading pats 21 and 22 extend parallel to the feed path 12, and that the robot 15 with the gripper devices 16 is suitable for picking up individual products or groups of products S from the feed-conveyor path 11 and placing them, preferably in alternation, in boxes P that move past. In other words, the gripper devices 16 grasp a group of products S and put them down into one or more boxes P on one or the other loading path 21 or 22. Then the gripper devices 16 grasp a further group of products S from the conveyor device 11 and put them down into one or more boxes P of the other loading path, 22 or 21, respectively.

In the advantageous embodiment of the invention shown here, the following disposition in the transverse direction of the platform 10 is provided (that is, in the direction from one long edge 13 to the other long edge 14): conveyor device 11, first product transporting device 31, second product transporting device 32, and robot 15. However, it is also possible for the feed device 11 to be disposed between the first and second product transporting devices 31 and 32, or for the conveyor belt 11 to be disposed between the second product transporting device 32 and the robot arm 15. More than two loading paths 21 and 22 may also be provided, for instance three of them, in which case the order transversely to the paths may be as follows: conveyor device 11, first product transporting device 31, second product transporting device 32, third product transporting device, and finally, robot 15.

In known packaging machines, upstream of a filling or loading device with the robot 15, an erecting device 41 and 42, respectively, is provided, and downstream of the loading device with the already-filled boxes P, there is a closure device 51 and 52, respectively.

The contrary disposition of the conveyor paths 21 and 22 means that the two erecting devices 41 and 42 and the closure devices 51 and 52, respectively, are disposed on diametrically opposite sides of the robot 15. In an advantageous exemplary embodiment, the arrangements 41 and 42 and 51 and 52 are enclosed in an upward-extending, block-shaped chamber, as is shown schematically in the drawing. In particular, the two diametrically opposed closure devices 51 and 52 are disposed in the corners of the platform 10. In another embodiment, the opposite corners, that is, the corners of the platform 10 located in an extension of the feed path 12, can be used. Between these devices 51 and 52 and the filling device 15 are the two erecting devices 42 and 41, respectively, which perform the steps of separating the blanks, the folding operation, and erecting the boxes P, from top to bottom down to the level of the conveyor paths 21 and 22 above the platform 10. The same is advantageously true for the functions of the closure devices 51 and 52, in which the closure of the lid of the boxes S, stapling of the boxes, and their discharge are performed from bottom to top, away from the platform 10.

The required electronics can be accommodated as in the prior art in an electronics cabinet, which can be provided in particular on one long side of the platform 10.

The device of the invention and the method of the invention thus enable faster filling of packaging materials P with products S in a space of comparatively the same size, in particular on a platform 10.

The foregoing relates to a preferred exemplary embodiment of the invention, it being understood that other variants and embodiments thereof are possible within the spirit and scope of the invention, the latter being defined by the appended claims.

The invention claimed is:

1. A packaging station having a packaging machine filling containers with products, comprising:

a conveyor device feeding the products along a feed path;

a first loading path, disposed parallel to the feed path, the first loading path including a first transporting device transporting the containers from a first erecting device to a first filling device and a closing device that closes the containers after the first filling device inserts the products into the containers;

a second loading path, disposed parallel to the first loading path, the second loading path including a second transporting device transporting containers of a same type as the first loading path from a second erecting device to the filling device and a second closing device; and the filling device grasping one or more products from the feed path and inserting grasped products into one or more containers selectively to either of the first loading path and the second loading path, and wherein the transporting device of the first loading path is operated in an opposing direction than that of the second loading path.

2. The packaging station as defined by claim 1, further comprising three or more loading paths in sequence, in the direction of motion of the containers to be filled, of an erecting device, a transporting device, and a closure device.

3. The packaging station as defined by claim 2, wherein the filling device is a 2- or 3-axis robot, and/or that the filling device is operable to successively supply the containers on the individual loading paths with one product or a group of products.

4. The packaging station as defined by claim 2, wherein the loading paths respectively, with the erecting device respectively, the transporting device respectively, and the closure device respectively, are disposed together with the filling device and the conveyor device on a platform, advantageously a rectangular platform.

5. The packaging station as defined by claim 4, wherein closure devices are provided in two of the corners of the platform that are located diametrically opposite the conveyor device for the products, and/or that the filling device is disposed approximately centrally on the platform relative to the paths.

6. The packaging station as defined by claim 1, wherein the filling device is a 2- or 3-axis robot, and/or that the filling device is operable to successively supply the containers on the individual loading paths with one product or a group of products.

7. The packaging station as defined by claim 1, wherein the loading paths respectively, with the erecting device respectively, the transporting device respectively, and the closure device respectively, are disposed together with the filling device and the conveyor device on a platform, advantageously a rectangular platform.

8. The packaging station as defined by claim 7, wherein the closure devices are provided in two of the corners of the platform that are located diametrically opposite the conveyor device for the products, and/or that the filling device is disposed approximately centrally on the platform relative to the paths.

9. The packaging station as defined by claim 1, wherein with the erecting device of each loading path, separation of the blanks, folding of the blanks, and erecting of the boxes from above the platform downward into a region of the transporting device in a vicinity of a plane of the platform is achieved, and/or with the closure device of each loading path, closure of a lid of the boxes, stapling of the boxes, and discharge of the boxes in succession away from a level of the transporting devices in the vicinity of the plane of the platform is performed therefrom vertically upward.

10. In a method for filling containers with products in a packaging station of a packaging machine, the method comprising the steps of:

feeding products along a feed path with a conveyor device;

feeding empty containers using a first loading path disposed parallel to the feed path;

feeding empty containers of a same type as on the first loading path using a second loading path disposed parallel to the feed path;

filling the containers with the aid of a filling device which grasps one or more products from the feed path and inserts grasped product or products into one or more containers selectively to either the first loading path or the second loading path;

and in a sequence of each loading path, erecting the empty containers in an erecting device before they are fed selectively to either the first loading path or the second loading path, moving the containers along its respective path via a transporting device, and after the containers are filled, closing the containers with the aid of a closure device, wherein the transporting device of each sequence is operated in opposite directions from one another.

* * * * *

UNITED STATES PATENT AND TRADEMARK OFFICE

CERTIFICATE OF CORRECTION

PATENT NO. : 8,393,132 B2
APPLICATION NO. : 11/914672
DATED : March 12, 2013
INVENTOR(S) : Juerg Waeckerlin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 826 days.

Signed and Sealed this
First Day of September, 2015

Michelle K. Lee

Michelle K. Lee
*Director of the United States Patent and Trademark Office*